US010369830B2

(12) United States Patent
Peleman

(10) Patent No.: US 10,369,830 B2
(45) Date of Patent: Aug. 6, 2019

(54) METHOD FOR BINDING A BUNDLE OF LEAVES, A BUNDLE OF LEAVES, METHOD AND DEVICE FOR FORMING SUCH A BUNDLE OF LEAVES

(71) Applicants: UNIBIND LIMITED, Nicosia (CY); Guido Peleman, Antwerp (BE)

(72) Inventor: Guido Peleman, Antwerp (BE)

(73) Assignee: UNIBIND LIMITED, Nicosia (CY)

( * ) Notice: Subject to any disclaimer, the term of this patent is extended or adjusted under 35 U.S.C. 154(b) by 486 days.

(21) Appl. No.: 14/438,379

(22) PCT Filed: Oct. 28, 2013

(86) PCT No.: PCT/IB2013/002315

§ 371 (c)(1),
(2) Date: Apr. 24, 2015

(87) PCT Pub. No.: WO2014/072778

PCT Pub. Date: May 15, 2014

(65) Prior Publication Data

US 2015/0283843 A1 Oct. 8, 2015

(30) Foreign Application Priority Data

Nov. 7, 2012 (BE) ..... 2012/0759
Jan. 9, 2013 (BE) ..... 2013/0014

(51) Int. Cl.
*B42C 5/00* (2006.01)
*B42B 5/06* (2006.01)
(Continued)

(52) U.S. Cl.
CPC ..... *B42C 5/00* (2013.01); *B31F 1/08* (2013.01); *B42B 5/06* (2013.01); *B42C 9/0056* (2013.01);
(Continued)

(58) Field of Classification Search
CPC ..... B42C 5/00; B42B 5/00; B41F 1/08
(Continued)

(56) References Cited

U.S. PATENT DOCUMENTS 696,281 A * 3/1902 Toole ..... B42D 1/003 281/41
1,678,917 A * 7/1928 Roush ..... B65H 45/12 493/405
(Continued)

FOREIGN PATENT DOCUMENTS

JP 3150449 U 5/2009
KR 10-1138309 B1 4/2012

OTHER PUBLICATIONS

International Search Report for PCT/IB2013/002315 dated Apr. 1, 2014.
(Continued)

*Primary Examiner* — Kyle R Grabowski
(74) *Attorney, Agent, or Firm* — Sughrue Mion, PLLC

(57) ABSTRACT

Method for binding a bundle (5) of leaves (1) in a binding back (7), whereby the bundle (5) is placed in the binding back (7) with an edge (2) of the leaves (1) and fastened therein, characterized in that for the binding use is made of a bundle (5) of leaves (1) of which a strip (4) of each of the leaves (1) has been separately double folded beforehand along the same line to form a fold line (3) that extends parallel to and at a distance (A) from the aforementioned edge (2).

16 Claims, 9 Drawing Sheets

Figure 1:
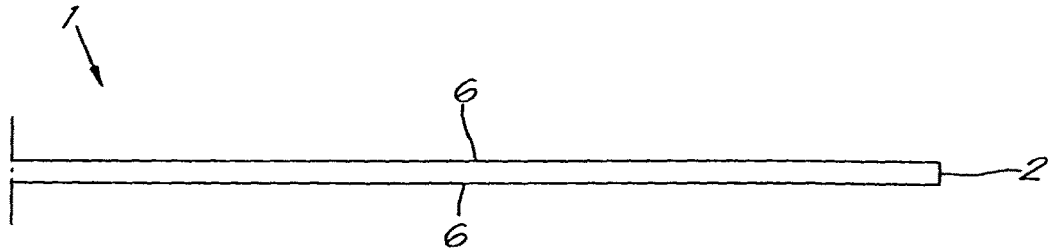

(51) Int. Cl.
*B31F 1/08* (2006.01)
*B42D 1/00* (2006.01)
*B42C 9/00* (2006.01)

(52) U.S. Cl.
CPC ..... *B42D 1/002* (2013.01); *B42D 1/006* (2013.01); *Y10T 428/23* (2015.01); *Y10T 428/24198* (2015.01)

(58) Field of Classification Search
USPC ..... 412/4, 5, 900; 281/40
See application file for complete search history.

(56) References Cited

U.S. PATENT DOCUMENTS 1,897,839 A * 2/1933 Gale ..... B42C 5/00 281/40
1,913,320 A 6/1933 Woodward
4,283,871 A 8/1981 Applebaum et al.
5,066,182 A * 11/1991 Stonebraker ..... B42B 5/00 281/21.1
5,207,456 A * 5/1993 Danhoff ..... B42D 1/004 281/40
7,823,927 B2 * 11/2010 Hoarau ..... B42B 5/06 281/21.1
2007/0203008 A1 8/2007 Parker et al.
2011/0316266 A1 12/2011 Miranti
2012/0169036 A1 7/2012 Huotari et al.
2013/0189055 A1 * 7/2013 Bloomberg ..... B42B 5/06 281/21.1

OTHER PUBLICATIONS

Written Opinion for PCT/IB2013/002315 dated Oct. 28, 2013.
International Preliminary Report on Patentability for PCT/IB2013/002315 dated Oct. 28, 2013.

* cited by examiner

METHOD FOR BINDING A BUNDLE OF LEAVES, A BUNDLE OF LEAVES, METHOD AND DEVICE FOR FORMING SUCH A BUNDLE OF LEAVES

CROSS REFERENCE TO RELATED APPLICATIONS

This application is a National Stage of International Application No. PCT/IB2013/002315 filed Oct. 28, 2013, claiming priority based on Belgian Patent Application Nos. 2012/0759 filed Nov. 7, 2012 and 2013/0014 filed Jan. 9, 2013, the contents of all of which are incorporated herein by reference in their entirety.

The present invention concerns a method for binding a bundle of leaves, for example to form a book or similar, in particular to obtain a book or folder whose leaves can be opened flat and the printing continues seamlessly over the two opened leaves. This last aspect is particularly desired for composing books of photographs, magazines and similar, with photographs and illustrations that run over the entire width of the opened book.

Traditionally a book is composed of quires of a number, for example sixteen, of leaves folded in half. These quires are sewn along the fold line in the middle, and the backs of a number of quires are sewn together on the outside.

This set is then bonded to a gauze. Because the gauze is very flexible, it will ensure that the pages lie flat after opening the book.

Leaves folded in half are always needed to manufacture a sewn book.

A disadvantage is that such books cannot be used for manufacturing a book of photographs or example, because the printing machines or printers used to print the pages of a book of photographs operate with precut sheets of photographic paper.

Such precut leaves cannot be sewn to form such a book of photographs.

Books are also known that are manufactured from a bundle of single leaves not folded in half.

Conventionally a book composed of a bundle of single leaves is made by bonding one edge of the bundle of single leaves.

In order to make this bond strong such that no leaves come loose when the book is opened and closed, the bundle of leaves will always sit in the adhesive over a limited distance, for example half a millimeter, so that the adhesive also gets between the leaves of the bundle.

Current adhesives are very flexible such that they allow the book to be opened completely flat after bonding without the leaves coming loose.

However, by completely opening the book the adhesive, which gets between the leaves during bonding, is clearly visible.

This visible adhesive is inconvenient when the printing of the leaves continues up to the binding. After all this adhesive will go over the printing and reduce the aesthetic appearance of the printing.

Leaves with an integrated, laminated and printable hinge are already known, which enable a bundle of these leaves to be bound to form a book or similar, whereby the pages are flat after opening the bundle.

However, the manufacture of such leaves is an expensive process and the processing is labour intensive.

The purpose of the present invention is to provide a solution to one or more of the aforementioned and other disadvantages.

The subject of the present invention is a method for binding a bundle of leaves in a binding back, whereby the bundle is placed in the binding back with an edge of the leaves and fastened therein, whereby for the binding use is made of a bundle of leaves of which a strip of each of the leaves has been separately double folded beforehand over an angle of at least 120° along the exact same line to form a fold line that extends parallel to and at a distance from the aforementioned edge whereby the leaves of the bound bundle are double folded at the same distance from the edge.

An advantage of such a method is that the fold line enables the leaves to be folded out along this fold line when the book is opened, and that when the bundle of leaves is bound in the back, the leaves lie with their sharp fold lines against one another, so that the leaves can be opened flat and that printing can continue across the opened leaves as good as seamlessly over two adjacent fold lines.

Another advantage is that when the bundle is opened there is no split between the opened leaves, so that the adhesive or stitching or staples that are used to bind the bundle in the back are not visible and thus do not disturb the printing that runs from the one leaf to the other leaf.

Preferably use is made of a bundle of leaves of which the strip of the leaves is folded back into the plane of the leaves.

As a result the binding will proceed smoothly, accurately and easily and this in the same traditional way as a conventional bundle without double-folded leaves.

Preferably the distance between the fold line and the edge of the leaves is chosen such that when opening the bound bundle, the opened leaves are flat or practically flat.

Flat here means that the plane of the one leaf is in the plane of the other leaf, such that the set of two leaves extends in one plane such that the set of two leaves can be considered as flat or practically flat.

This will facilitate the reading of the text printed on the leaves for example, because they do not bulge up on the binding side. With photographs that are printed on the leaves, the absence of bulging of the leaves on the binding side will increase the aesthetic character.

According to the invention all leaves in the bundle are double folded at the same distance from the edge to be bound.

An advantage of this is that the folding can be easily automated using machines.

This will be applied in particular with prefolded leaves.

According to a preferred characteristic the binding back is a V-shaped or U-shaped binding back and the distance between the fold line and the edge of the leaf essentially corresponds to the depth of the binding back, whereby this distance is preferably somewhat greater than the depth of the binding back.

This has the advantage that at the level of the fold line the leaves can be folded over the binding back when the bundle is secured in the binding back.

According to a preferred characteristic the aforementioned distance is between 10 and 14 mm and preferably 12 mm.

According to a preferred characteristic the binding back is a metal binding back that is provided with a hotmelt adhesive that is made to melt during binding in order to fasten the leaves along their aforementioned edge after solidification.

An advantage of this is that this method enables the bundle to be secured in the binding back in a fast and practical way. Because the leaves fold open at the level of the fold line, when the bundle is opened the adhesive at the edge cannot be seen.

Preferably the arms of the metal binding back are squeezed together after placing the bundle in order to clamp the bundle in the binding back.

This has the advantage that the bundle is firmly anchored in the binding back. Moreover, the squeezed binding back will hold the leaves together when the bundle is opened, so that the fold lines of the leaves lie against one another and there will be no split between the bundle and the edges of the arms of the binding back, such that adhesive and similar are concealed from view.

According to a preferred characteristic, the bundle is stapled before binding.

An advantage of such a method is that in principle no adhesive is necessary to hold the bundle in the binding back, it is sufficient to place the stapled bundle in a binding back and then to squeeze the binding back closed such that the bundle is clamped in the binding back.

According to a preferred characteristic the leaves are first provided with printing that continues up to the aforementioned fold line.

According to a preferred characteristic the sides of adjacent leaves oriented towards one another are provided with printing beforehand that continues over the fold line of both leaves, as it were seamlessly, from one side to the other side to which the part of the printing is applied on one side up to the fold line of the leaf concerned and the part of the printing of the other side is applied up to the fold line of the adjacent leaf.

An advantage of this is that the printing, for example a photograph, can run across two sides of adjacent leaves. Moreover, the printing does not have to continue up to the aforementioned edge, such that the printing of the leaves is easier.

Preferably the printing on one side and the printing on the other side continue with an overlapping part over the fold line.

This has the advantage that when the bundle is opened a thin unprinted line is not visible at the level of the fold lines, when for example a small deviation or inaccuracy occurs during the prior double folding of the leaves or during the binding of the bundle.

In a preferred embodiment one or two endpapers of a folder or book are affixed in the binding back.

This endpaper has the advantage that it will protect the printing on the outermost side of the outermost leaves of the bundle against damage or wear.

Preferably the endpapers are folded completely outwards with respect to the arms of the binding back, up to against or almost against the arms of the binding back.

This will ensure that the binding back can be turned around an axis that is parallel to the fold line when leafing through the bundle.

As a result of this the pages will lie flat while leafing through the bundle.

The invention also concerns a bundle of leaves, whereby a strip of at least a part of the leaves has each been double folded separately over an angle of at least 120° along the exact same line to form a fold line that extends parallel to and at a distance from an edge, whereby the distance for the aforementioned part of the leaves is the same.

Preferably the leaves of the bundle are flat, because the strip of each leaf is folded back separately to the plane of the leaf and the aforementioned distance is between around ten and fourteen millimeters.

It is not excluded that this distance is greater, for example 15 or 20 millimeters.

Furthermore the invention also concerns a book or folder with a binding back and a bundle of leaves bound therein, whereby the bound bundle is a bundle according to the invention.

Furthermore the invention also concerns a method for forming a bundle of leaves according to the invention, whereby each leaf of the bundle is double folded separately by applying the following steps: the clamping of a leaf to be folded between two plates except for a strip with a width that protrudes between the plates, the partial folding of the protruding strip in a direction perpendicular to the plane of the leaf, the further folding of the strip by pushing the plates with the partially folded strip into the funnel-shaped groove or between two rollers with sprung or fixed suspension or by moving the profiled element with the funnel-shaped groove over the edge of the plates, moving the funnel-shaped groove and the plates with the folded strip away from one another, folding back the folded strip up to the plane of the leaf and further up to a partially folded position of the strip on the opposite side of the plates, the further folding of the strip by pushing the plates with the partially folded strip into the funnel-shaped groove or between two rollers with sprung or fixed suspension, or by moving the profiled element with the funnel-shaped groove over the edge of the plates and then withdrawing it back and folding the folded strip back into the plane of the leaf.

Such a method will enable a leaf to be double folded to be folded along the same line.

Furthermore the invention also concerns a device for applying the method for forming a bundle of leaves according to the invention, whereby the device is provided with clamping means to clamp each leaf of the bundle along a line at a distance from the edge of the leaf to form a protruding strip with a width equal to the aforementioned distance, and with folding means to completely or almost completely fold this strip along the aforementioned line with respect to the clamping means, in order to form a fold line at the aforementioned distance from the edge of the leaf.

In a preferred embodiment the clamping means are formed by two plates between which each leaf can be clamped, each with an edge aligned with the line along which the leaf must be folded.

By clamping the leaf between two plates, the leaf can be double folded along the same line to form a fold line.

These plates can be made of steel for example, and have a thickness of 0.3 millimeters.

The folding means are preferably formed by a profiled element with a funnel-shaped groove that extends along a direction parallel to the plane of the leaf to be folded.

In a preferred embodiment the device is provided with means to move the folding means and the clamping means with the leaf clamped therein with respect to one another in a direction parallel to the plane of the leaf to be folded, between a position whereby the leaf to be folded is in line with the funnel-shaped groove and a position whereby the leaf is in the funnel-shaped groove with the aforementioned strip up against the bottom of the funnel-shaped groove.

Preferably the device is further provided with means to fold the strip of the clamped leaf perpendicularly with respect to the clamping means before the leaf is placed in the funnel-shaped groove.

These means are formed for example by the fact that the clamping means are provided with a drive that enables the clamping means to move with respect to the folding means in a direction perpendicular to the plane of the leaf.

The means to move the folding means and clamping means with respect one another in a direction parallel to and perpendicular to the plane of the leaf, enable the folding of the leaves to be done automatically.

In a preferred embodiment, at the location of the entrance of the funnel-shaped groove the folding means are provided with two or more rollers with a sprung or fixed suspension between which the leaf can move in the groove.

The dimensions of these rollers can be such that they can touch one another. When the rollers are made of metal, they are provided with a sprung suspension in order to allow the plates through between the rollers. When the rollers are made of rubber or similar material, they can be provided with a fixed suspension.

In this way the leaf is not exposed to sliding or rubbing movements when it is moved in the groove, but the rollers will roll over the surface of the leaf. As a result the printing on the surface of the leaf will not be damaged.

Figure 7:
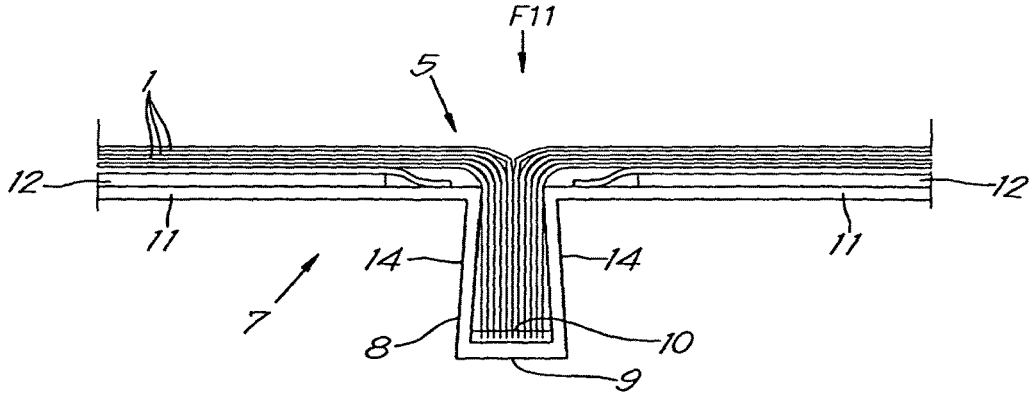
Figure 8:
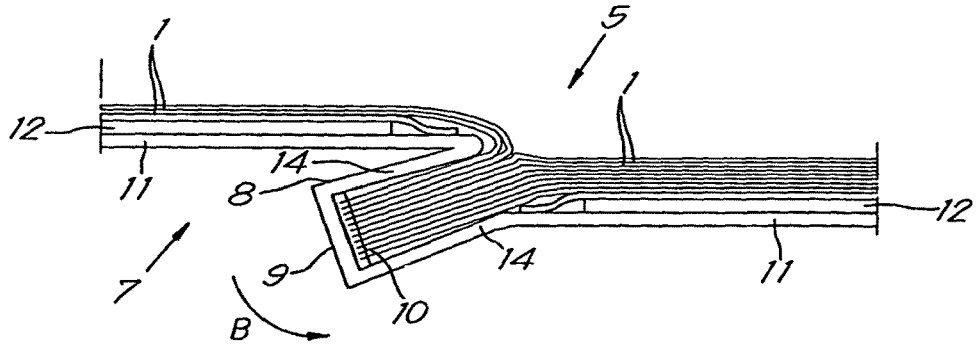
Figure 9:
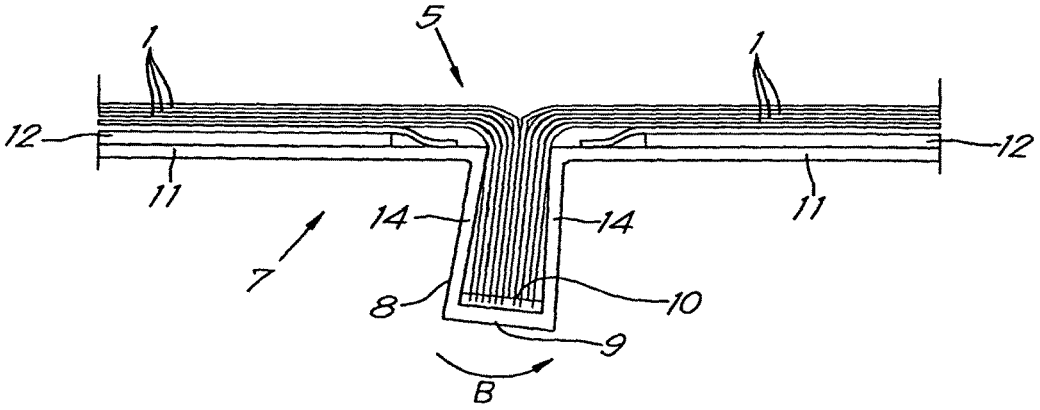
Figure 10:
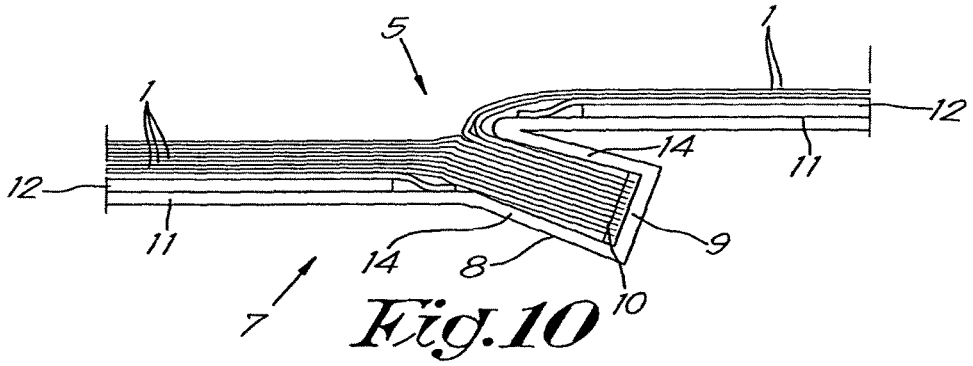
Figure 11:
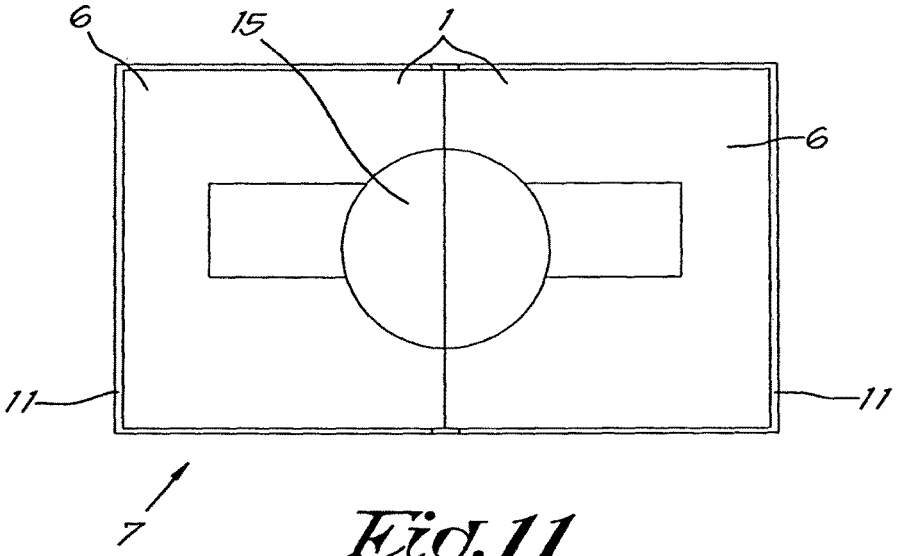
Figure 12:
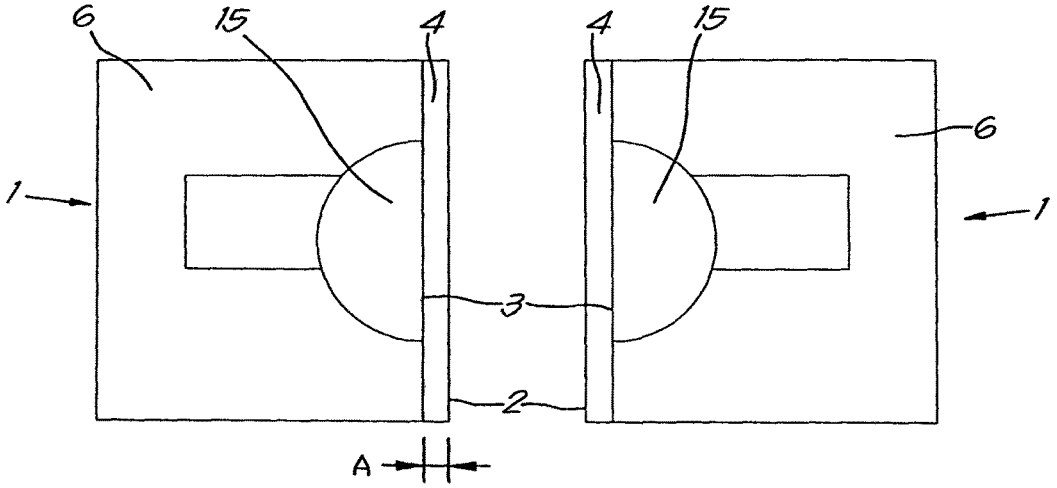
Figure 13:
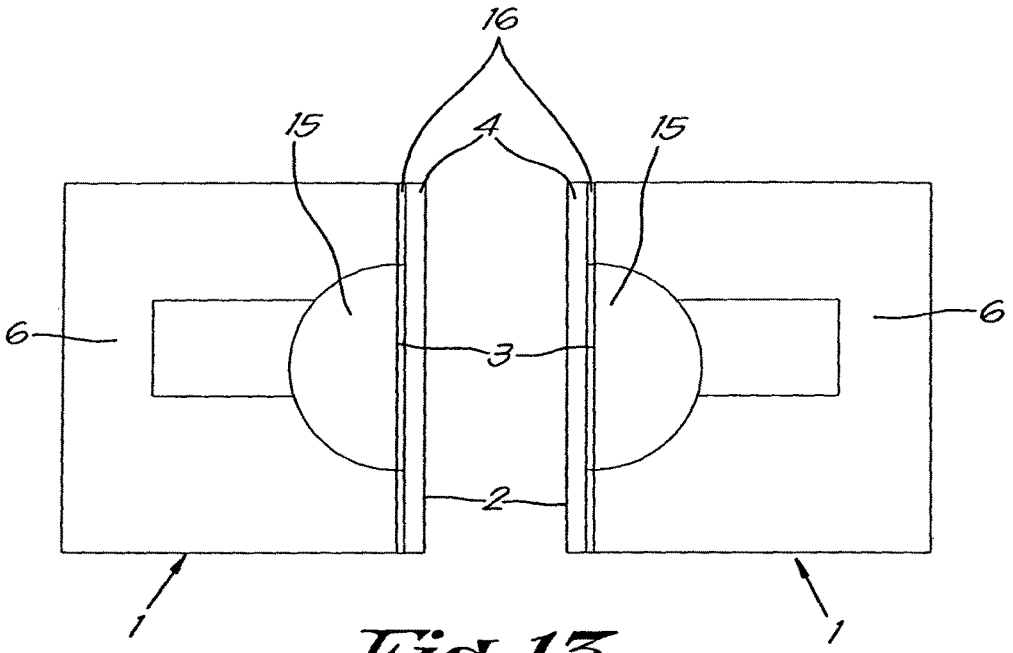
Figure 14:
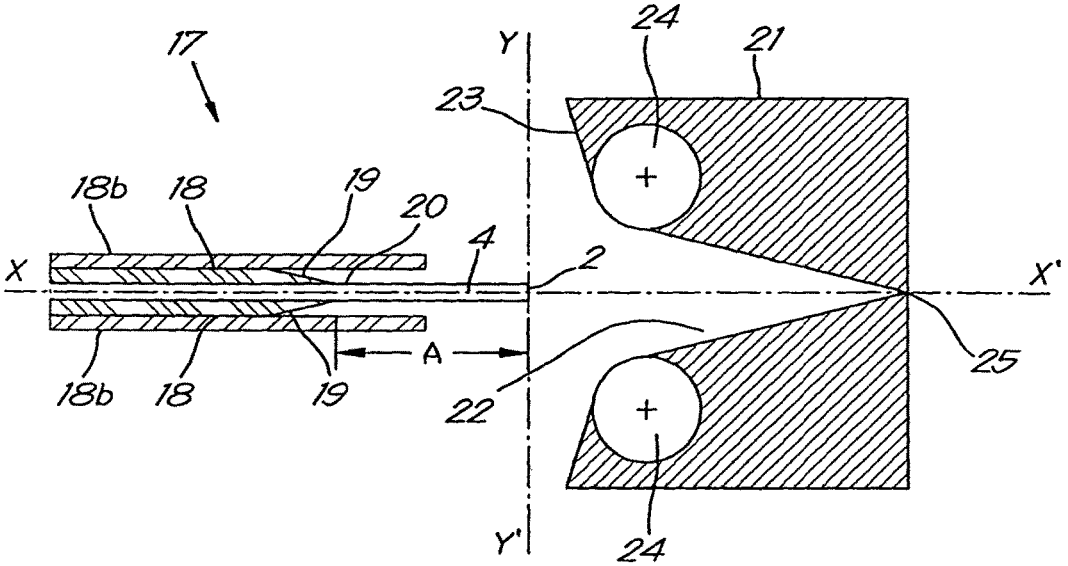
Figure 24:
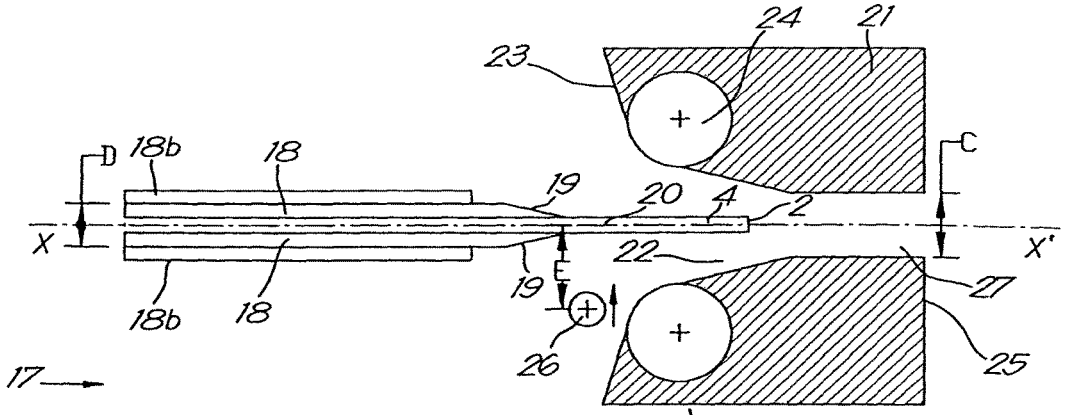
Figure 25:
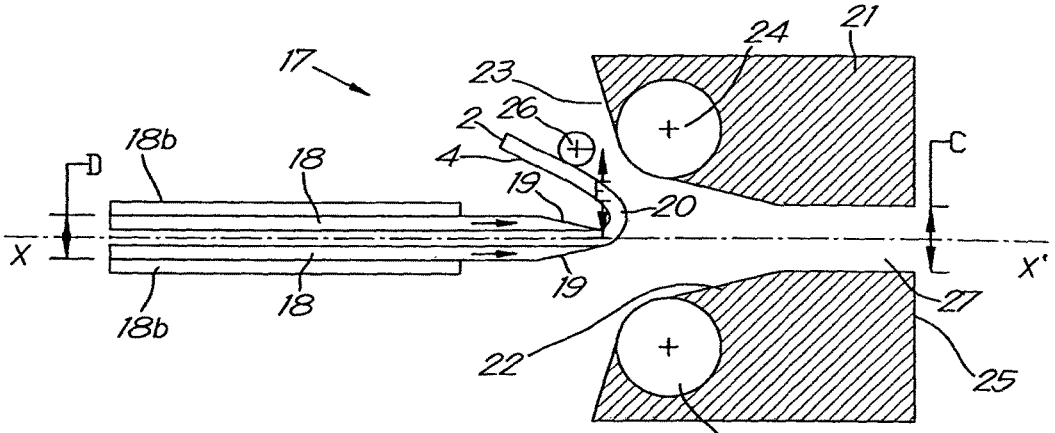
Figure 26:
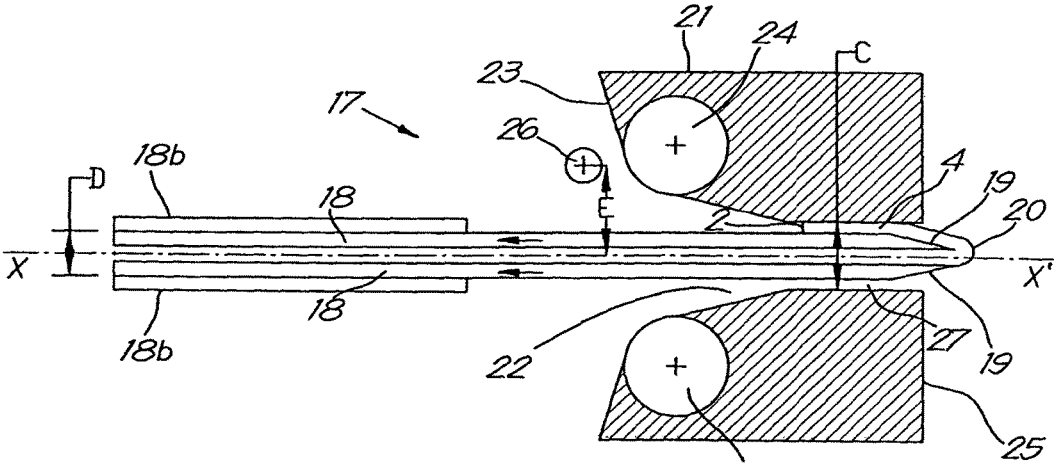

With the intention of better showing the characteristics of the invention, a preferred method for binding a bundle of leaves according to the invention is described hereinafter by way of an example, without any limiting nature, with reference to the accompanying drawings, wherein:

FIGS. 1 to 7 schematically show the successive steps of a method according to the invention;

FIGS. 8 to 10 schematically show the bundle of FIG. 7 while being leafed through;

FIG. 11 schematically shows a view according to the arrow F11 of FIG. 7;

FIG. 12 schematically shows the folded leaves of FIG. 11, but in a loose separated position;

FIG. 13 schematically shows an alternative embodiment of FIG. 12;

FIG. 14 schematically shows a device for sharply double folding a leaf;

FIGS. 15 to 23 schematically show the successive different steps of the use of the device, as shown in FIG. 14;

FIGS. 24 to 26 schematically show an alternative device for sharply double folding a leaf and different steps of the use of such a device.

FIGS. 1 to 4 schematically show a method for manufacturing a double-folded leaf 1.

Figure 2:
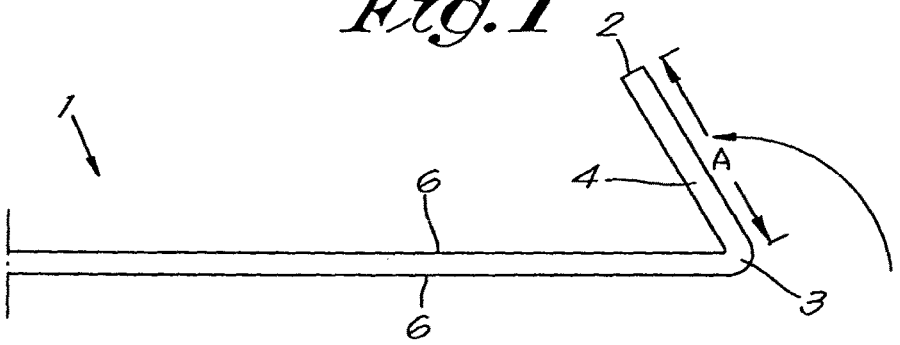

To this end a leaf 1 with an edge 2 is folded back along a fold line 3, which runs parallel to the edge 2 and at a distance A from it, in one direction as shown in FIG. 2.

In this way a strip 4 is formed that is demarcated by a fold line 3.

Figure 3:
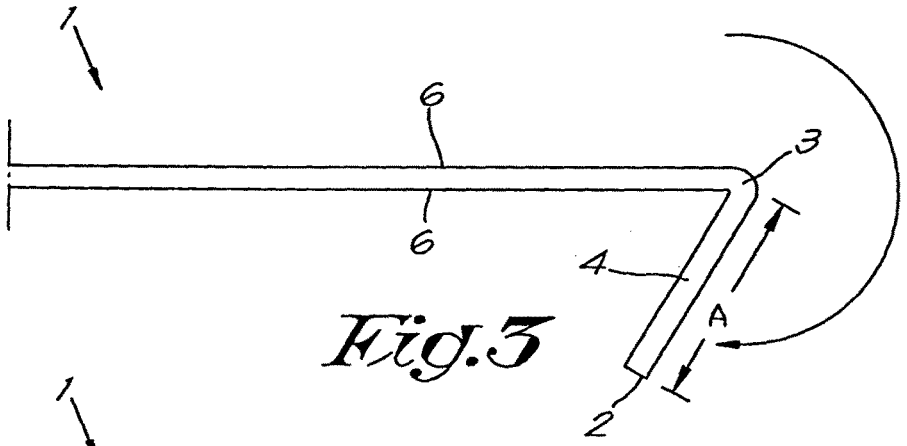

Then the strip 4 is folded in the other direction along the sharp fold line 3 as shown in FIG. 3.

The strip 4 is folded each time over an angle greater than 90°, as shown in FIGS. 2 and 3. In this case the angle is 120°.

However, it is not excluded that the angle over which the leaf 1 is folded is greater than 120°.

The folding of the leaf 1 over an angle greater than 90° and preferably at least 120° has the advantage that the leaf 1 will fold over the fold line 3 formed. When the angle is less than 90°, the leaf 1 will bend around the fold line 3.

Figure 4:
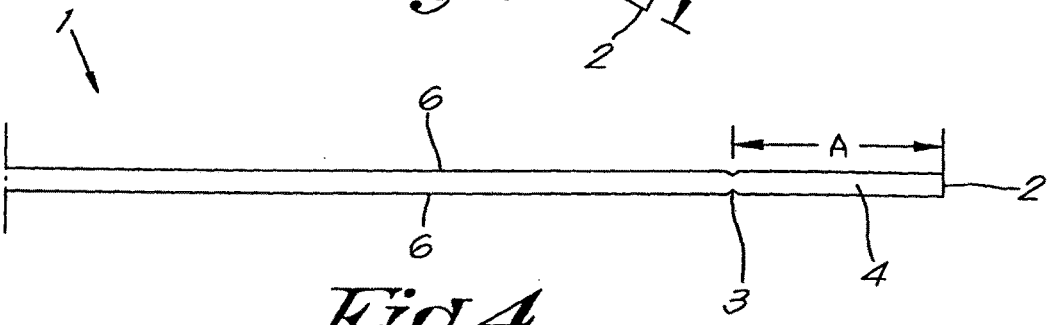

Finally, as shown in FIG. 4, the strip 4 is folded back in line with the leaf 1.

In this way a double-folded leaf 1 is made.

Preferably the strip 4 for forming a sharp fold line 3 is completely double folded. In this way the fold line 3 forms as it were a flexible hinge along which the leaf 1 can be flexibly turned back and forth with respect to the strip 4.

The distance A between the edge 2 and the fold line 3 is equal to the width of the strip 4.

Figure 5:
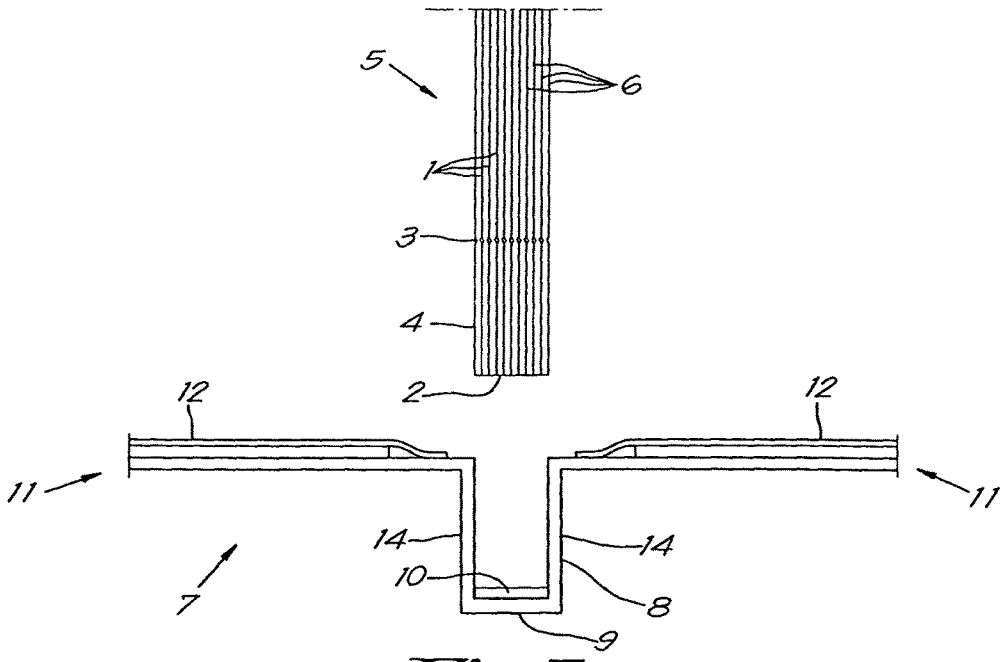
Figure 6:
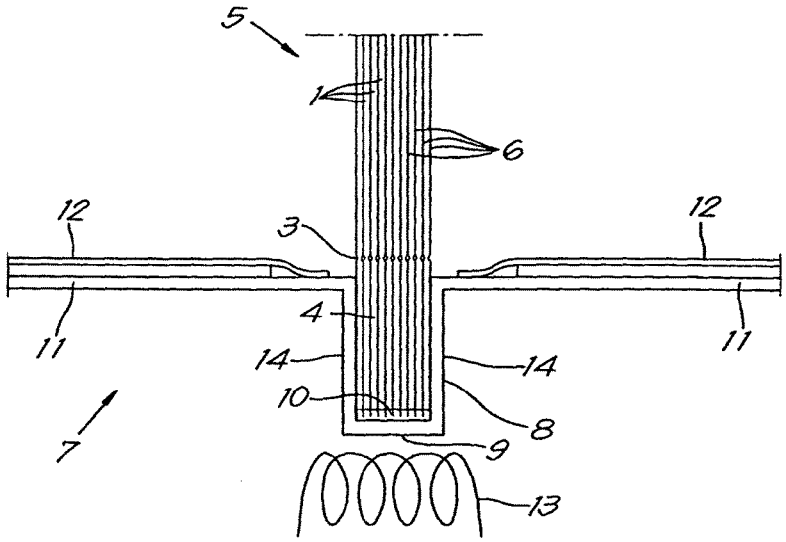

FIGS. 5 to 7 schematically show a method for binding a bundle 5 of double-folded leaves 1.

As shown in FIG. 5, the bundle consists of a number of double-folded leaves 1 that are placed with their sides 6 against one another, whereby the edges 2 of the leaves 1 to be bound are aligned with respect one another.

In this case the binding back 7 consists of a U-shaped part 8, for example of metal, with a layer of hotmelt adhesive 10 on the base.

The binding back 7 is further provided with two endpapers 11, for example of cardboard, that are provided with a covering 12 on either side.

It is clear that the binding back 7 can also take on other forms.

The bundle 5 is placed in the U-shaped part 8 of the binding back 7, whereby the edges 2 of the double-folded leaves 1 are placed up against the layer of hotmelt adhesive 10, as shown in FIG. 6.

Hereby the fold line 3 of the double-folded leaves 1 comes out somewhat above the U-shaped part 8.

Then the layer of hotmelt adhesive 10 is heated by means of a heat source 13. The hotmelt adhesive 10 will hereby melt and become liquid, such that the double-folded leaves 1 of the bundle 5 can be affixed therein.

After solidification of the hotmelt adhesive 10, the bundle 5 is attached to the bundle 7 via the hotmelt adhesive 10.

Then, as shown in FIG. 7, the arms 14 of the U-shaped part 8 of the binding back 7 are squeezed together. This will ensure an extra sturdy fixing of the bundle 5 in the binding back 7 and the fit of the bundle 5 against the free edges of the arms 14 without a split being visible between the two.

The bound bundle 5 is now finished into a folder with bound leaves 1.

As shown in FIG. 7, when opening the bundle 5, the double-folded leaves 1 will extend in one plane.

In reality the result is better than shown in the drawings, which give a somewhat distorted picture because a certain thickness has been given to the leaves for clarity.

FIGS. 8 to 10 schematically show how the U-shaped part 8 of the binding back 7 will turn when leafing through.

When an endpaper 11 is opened, it can be folded up against the arm 14 of the U-shaped part 8, as shown in FIG. 8.

When leafing through further, the arm 14 of the U-shaped part 8 will move away from this endpaper 11 because the U-shaped part 8 will turn towards the other endpaper 11 according to the arrow B. This is shown in FIG. 9.

When leafing even further through, as shown in FIG. 10, the U-shaped part 8 of the binding back will turn further until the other arm 14 of the binding back 7 is finally against the other endpaper 11.

This turning of the binding back 7 is done automatically as it were when leafing through the bundle 5, and will ensure that the leaves 1 extend flat when the bundle 5 is opened at a certain page.

As presented in FIG. 11, the sides 6 of the double-folded leaves 1 are printed, for example with a part of an illustration 15 or photograph, whereby the illustration 15 continues as good as seamlessly from the one double-folded leaf 1 to the other double-folded leaf 1 to thus form one continuous illustration. This is useful, for example, when composing a photograph album whereby large photographs can be provided in this way that extend over two leaves 1 and this without an inconvenient split between the two.

FIG. 12 shows two printed double-folded leaves 1, whereby after binding the printing 15 will form a single whole on both leaves 1 together.

Hereby the printing 15 is printed up to the fold line 3, whereby the strip 4 remains unprinted.

FIG. 13 shows a variant of this, whereby a part 16 of the strips 4 is also printed with an overlapping part of the printing 15.

It is clear that the hotmelt adhesive 10 can be left out, and that the bundle 5 can be stapled before being placed in the binding back 7.

It is also clear that the squeezing of the arms 14 of the U-shaped part 8 of the binding back 7 can be omitted.

A device 17 for forming a bundle 5 of leaves 1 according to the invention is shown in FIG. 14.

The device 17 is provided with two plates 18, in this case steel plates with a thickness of 0.3 millimeters, which act as clamping means 18.

The two plates 18 are affixed between two plates 18*b*. These plates 18*b* can be moved with respect to the leaf 1, which is clamped between the two plates 18. The plates 18 cannot be moved with respect to the leaf 1.

A leaf 1 is clamped between the two plates 18, which have their edge 19 aligned with a line 20 at a distance A from the edge 2 of the leaf 1 to form a protruding strip 4 with width A.

Furthermore the device 17 is also provided with a profiled element 21 with a funnel-shaped groove 22, which acts as a folding means 21.

At the entrance 23 of the groove 22 there are two rotatable rollers 24. The bottom 25 of the funnel-shaped groove 22 ends in a sharp point 25.

Furthermore the device 17 is also provided with means for moving the plates 18 with respect to the element 21 in a direction X-X' parallel to and in a direction Y-Y' perpendicular to the plane of the leaf 1, which for simplicity is not shown.

The successive steps of a method for forming a bundle 5 of leaves 1 according to the invention, in which the device 17 is used, are shown in FIGS. 15 to 23.

Figure 15:
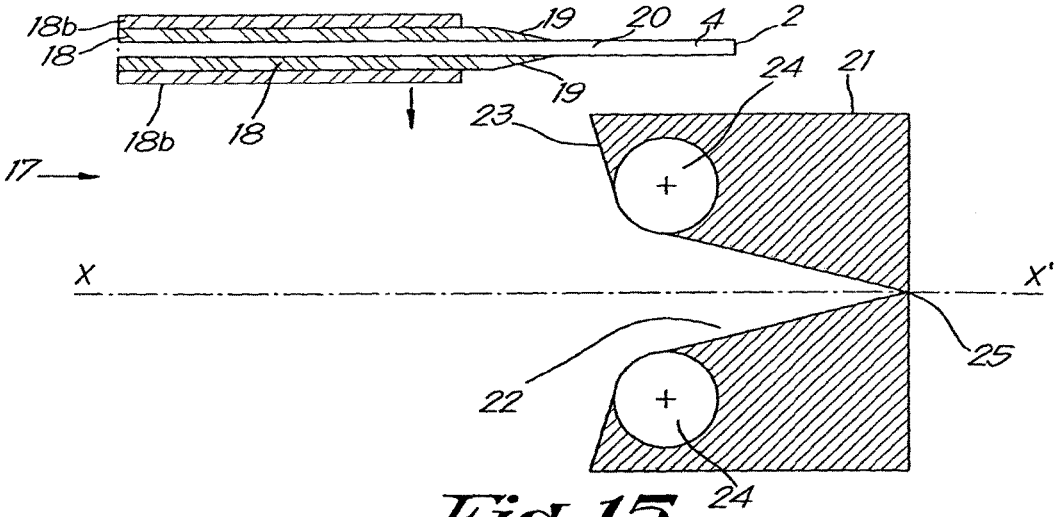

FIG. 15 shows how a leaf is clamped between the two steel plates 18, whereby a strip 4 of the leaf 1 protrudes between the steel plates 18 with a width A.

The plates 18 with the leaf 1 are above the element 21 in such a position that the strip 4 comes past the entrance 23 of the element 21.

Figure 16:
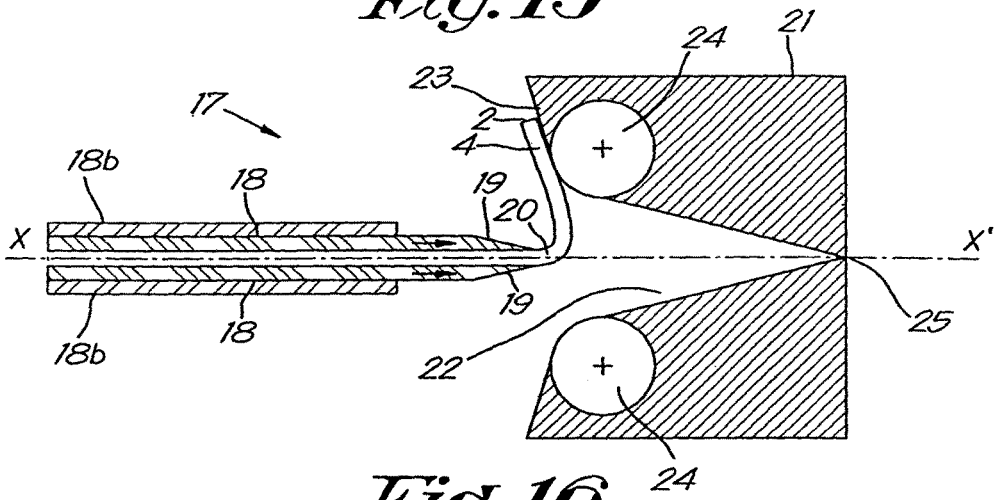

The plates 18 and are then moved towards the element 21, in such a way that the strip 4 of the leaf 1 is partially folded upwards as shown in FIG. 16.

Figure 17:
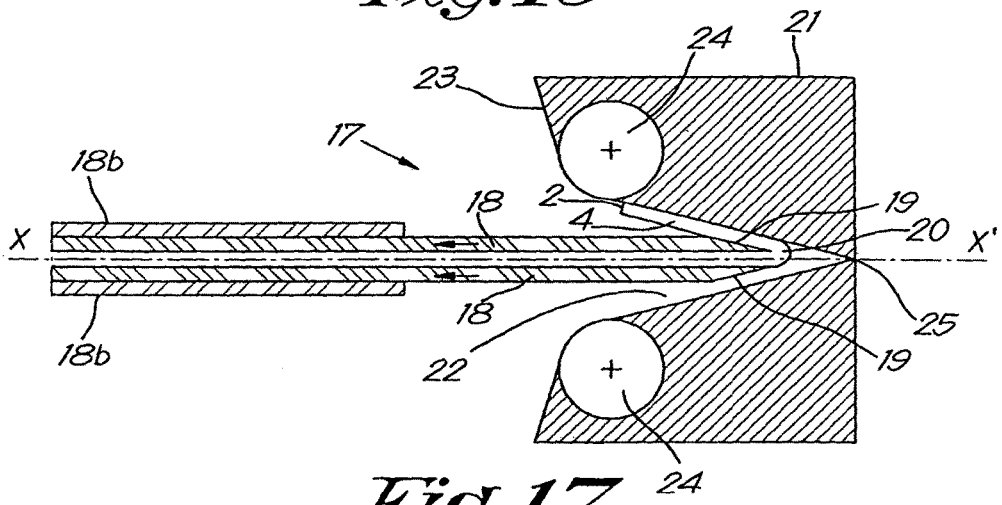

When the plates 18 are at the level of the funnel-shaped groove 22, they will move in the groove 22 as shown in FIG. 17. The plates 18*b* will hereby not move in the funnel-shaped groove 22, but will stay in place.

As a result, the rollers 24 will ensure that the leaf 1 between the plates 18 is readily guided in the groove 22.

When the plates 18 are as far as possible in the bottom 25 of the groove 22, the strip 4 will be folded upwards over the line 20 over the edge 19 of the plates 18, such that a sharp fold line 3 occurs.

As can be clearly seen in the drawings, the leaf 1 is folded by an angle greater than 120°. This will lead to a sharp fold line 3.

Figure 18:
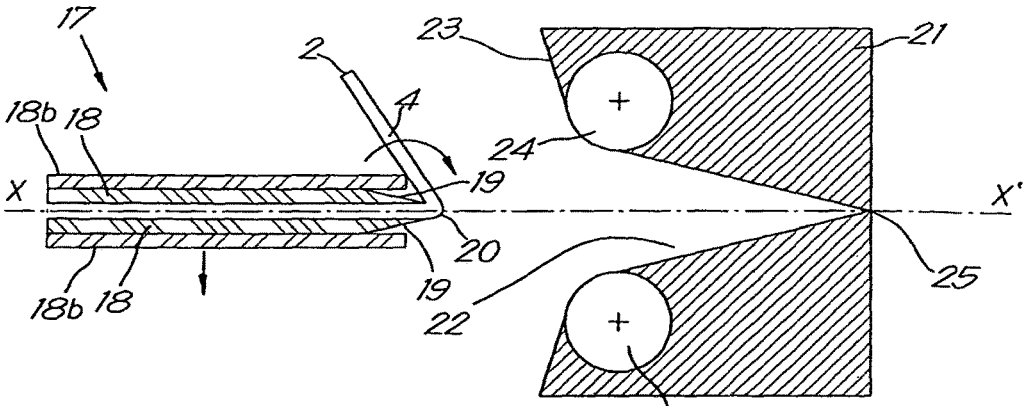
Figure 19:
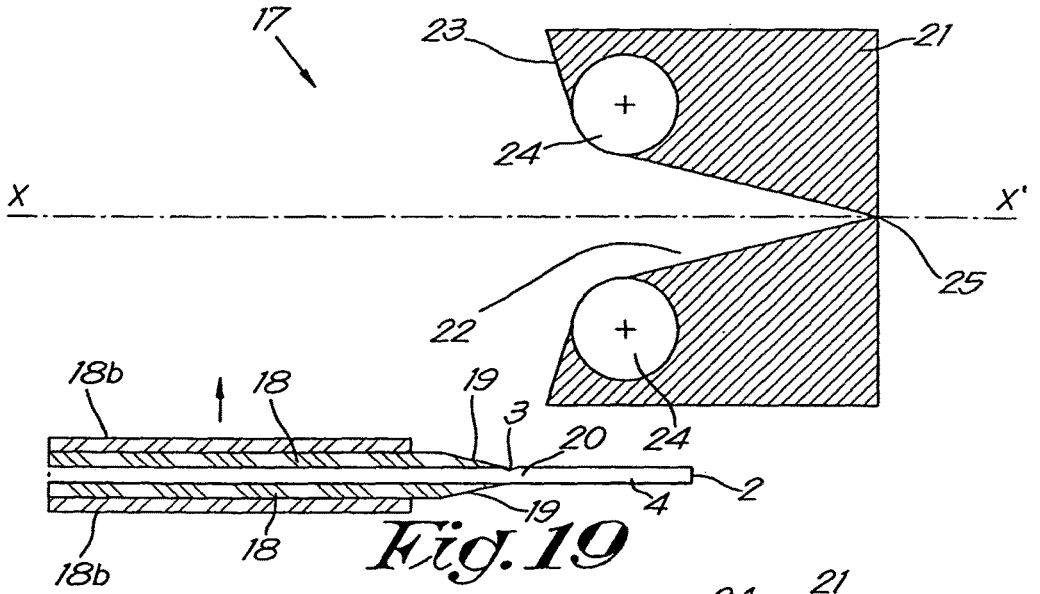

The plates 18 will then move back from the groove 22, and will as it were slide back in the plates 18*b*. The folded strip 4 is folded back in the plane of the leaf 1 using the plates 18*b*, as shown in FIG. 18.

The first sharp fold line 3 is formed. In order to fold the strip 4 over this fold line 3 in the other direction, upwards, over the same line 20 similar steps are performed, as shown in FIGS. 19 to 23.

The plates 18 with the leaf 1 are under the element 21 in such a position that the strip 4 comes past the entrance 23 of the element 21.

Figure 20:
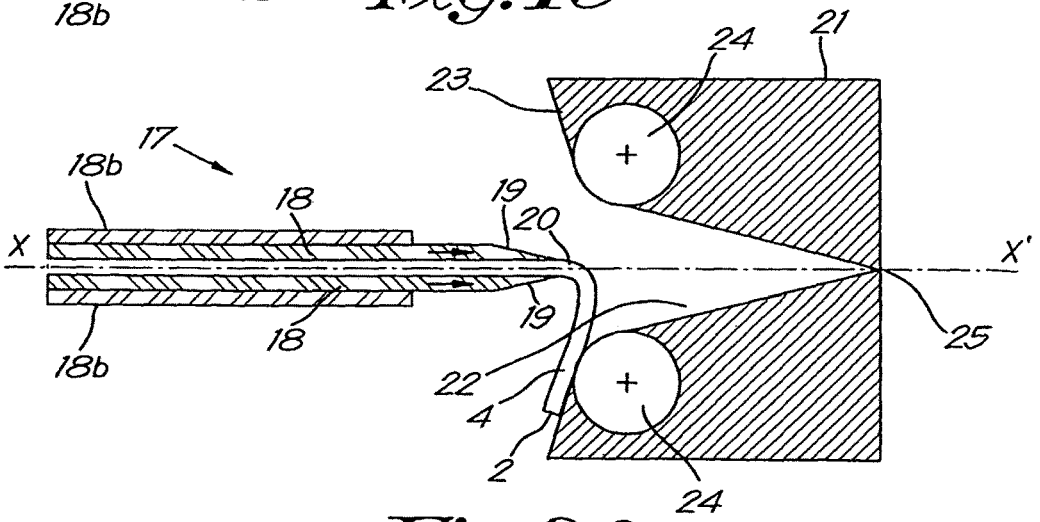

The plates 18 are then moved towards the element 21, in such a way that the strip 4 of the leaf 1 is partially folded downwards, as shown in FIG. 20.

Figure 21:
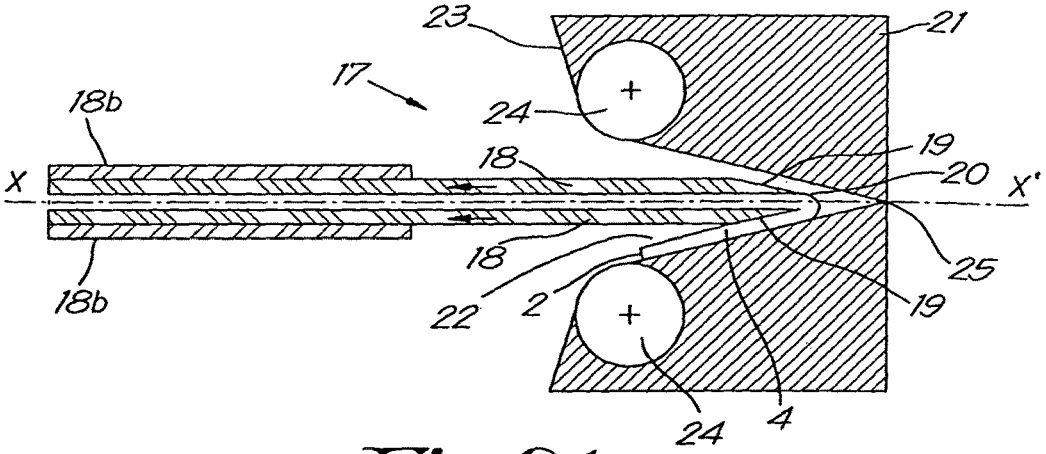

When the plates 18 are at the level of the funnel-shaped groove 22, they will then move in the groove 22, as shown in FIG. 21. The plates 18*b* will hereby not move in the funnel-shaped groove 22, but will stay in place.

As a result the rollers 24 ensure that the leaf 1 between the plates 18 is readily guided in the groove 22.

When the plates 18 are as far as possible in the point 25 of the groove 22, the strip 4 will be folded downwards over the line 20 over the edge 19 of the plates 18 such that a sharp fold line 3 occurs.

In this case too the leaf 1 is folded over an angle greater than 120°.

This sharp fold line 3 will be formed in the same line 20 as the previous fold line 3. In other word words, in this way a sharp double fold line 3 is made.

Figure 22:
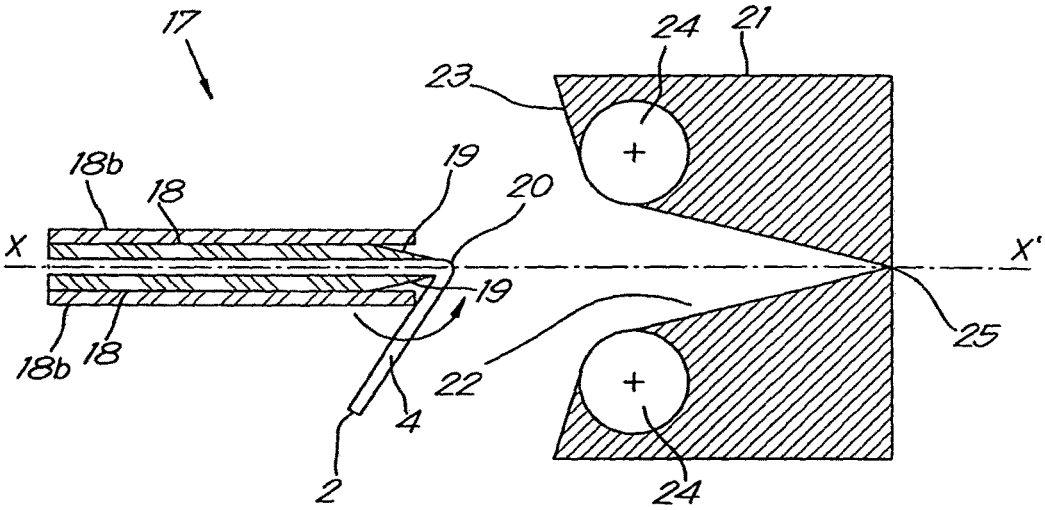
Figure 23:
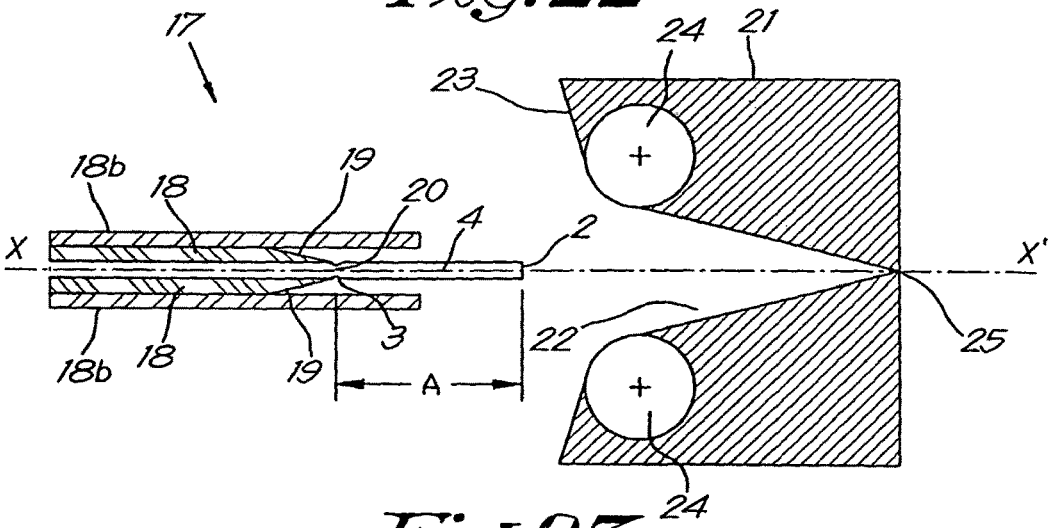

The plates 18 will then move back out of the groove 22, and will as it were slide back in the plates 18*b*. The folded strip 4 is then folded back in the plane of the leaf 1 using the plates 18*b*, as shown in FIGS. 22 and 23.

In this way a sharp double-folded leaf 1 can be made.

By using the plates 18 it can be ensured that the strip 4 is folded twice over exactly the same line 20.

The use of the funnel-shaped groove 22 ensures the sharp fold line 3.

It is clear that there can be even more rollers 24 in the funnel-shaped groove 22, or that there are absolutely no rollers 24 present.

It is also clear that the method can also be implemented by first performing the steps presented in FIGS. 19 to 23 and then the steps presented in FIGS. 15 to 18, in other words by first folding the strip 4 downwards and then upwards.

FIGS. 24 to 26 describe an alternative embodiment of a device 17 according to the invention, whereby in this case the plates 18 with the clamped leaf 1 and the profiled element 21 can move with respect to one another in only one single direction, i.e. in the direction of the plane of the leaf 1, whereby the plates 18 are positioned opposite the entrance 23 of the funnel-shaped groove 22.

The means to fold the strip 4 of the clamped leaf 1 perpendicularly with respect to the plates 18 are in this case formed by a separate element 26, for example a stylus 26, that is arranged movably between the plates 18 and the profiled element 21 in a direction Y-Y' perpendicular to the plane of the plates 18 and which extends parallel to the edge 19 of the plates 18.

Additionally, the bottom 25 of the funnel-shaped groove 22 can be open, whereby the width C of the opening 27 is somewhat wider than the thickness D of two plates 18 with clamped leaf 1.

The use of such an alternative embodiment differs in the fact that in this case the strip 4 of the leaf 1 is folded, before the plates 18 are placed in the funnel-shaped groove 22, by moving the element 26 upwards or downwards from a side of the plates 18 to the other side of the plates 18 in order to first fold the protruding strip 4 upwards or downwards perpendicularly. The element 26 hereby moves from one position on a side of the plates 18 to a subsequent position of the plates 18, whereby the two positions are situated at a perpendicular distance E from the plates that is less than the width A of the strip 4, such that when the plates 18 move in the funnel-shaped groove 22, the folded strip 4 remains caught behind the element 26.

When the plates 18 move in the funnel-shaped groove 22 their edge 19 will be able to move past the bottom 25 on account of the opening 27 in the bottom 25. This will lead to a very sharp fold line 3 being formed.

The present invention is by no means limited to the embodiments described as an example and shown in the drawings, but a method for binding bundles of leaves according to the invention can be realised in all kinds of variants, without departing from the scope of the invention.

The invention claimed is:

1. A method for binding a bundle (5) of leaves (1) in a binding back (7), comprising the following steps:

providing a plurality of leaves;

separately folding a strip (4) of each of the plurality of leaves, each respectively clamped between a plurality of plates, over an angle of at least 120° along a fold line (3), first in one direction and then in an opposite direction along the same fold line, the fold line extending parallel to an edge of each of the leaves at a distance (A) from the edge;

forming the plurality of leaves into a bundle of leaves; and placing the bundle (5) of leaves in the binding back (7) with the edge (2) of each of the leaves (1) received and fastened therein, wherein separately folding the strip further comprises steps of:

(a) extending at least one of the leaves, clamped between the plurality of plates, and the plates from a second plurality of plates and into a funnel such that the one of the leaves folds along the fold line by contacting at least a first wall of the funnel; and (b) retracting the one of the leaves and the plates from the first wall and into the second plurality of plates such that the one of the leaves, folded against the first wall, is unfolded along the fold line by contacting a first tip of the second plurality of plates.

2. The method according to claim 1, wherein the folding step comprises folding the strip of each of the plurality of leaves over and angle of 180° such that the strip (4) of the leaves (1) is folded back to the plane of the leaves (1).

3. The method according to claim 1, further comprising selecting the distance (A) between the fold line (3) and the edge (2) of the each of the plurality of leaves (1) such that when opening the bound bundle (5) the opened leaves (1) extend flat or substantially flat.

4. The method according to claim 1, further comprising selecting the binding back (7) to be a V-shaped or U-shaped binding back and selecting the distance (A) to correspond substantially to a depth of the binding back (7).

5. The method according to claim 4, further comprising squeezing d in respective arms (14) of the binding back (7) together after placing the bundle (5) therein in order to clamp the bundle (5) in the binding back (7).

6. The method according to claim 1, further comprising selecting the distance (A) to be greater than the depth of the binding back (7).

7. The method according to claim 1, further comprising selecting the distance (A) to be between 10 and 14 mm.

8. The method according to claim 7 wherein the distance (A) is selected to be approximately 12 mm.

9. The method according to claim 1, wherein the fastening comprises adhering the leaves to the binding back (7) with a hotmelt adhesive (10) that melts during binding in order to fasten the leaves (1) along each edge (2) thereof after solidification, said binding back being made of metal.

10. The method according to claim 1, further comprising stapling the bundle (5) together before the placing step.

11. The method according to claim 1, further comprising proving print on the leaves (1) before the folding step.

12. The method according to claim 1, wherein sides (6) of adjacent leaves (1) oriented towards one another are provided with printing (15) that runs seamlessly over the fold line (3) of both leaves (1) from one side (6) to the other side (6) to which the part of the printing (15) on one side (6) is applied up to the fold line (3) of the leaf (1) concerned and the part of the printing (15) of the other side (6) is applied up to the fold line (3) of the adjacent leaf (1).

13. The method according to claim 12, wherein the printing (15) on one side (6) and the printing (15) on the other side (6) continues with an overlapping section over the fold line (3).

14. The method according to claim 1, wherein one or two endpapers (11) of a folder or book are affixed to the binding back (7).

15. The method according to claim 14, wherein the endpapers (11) are configured to be completely folded outwards with respect to the arms (14) of the binding back (7) up to against or almost against the arms (14) of the binding back.

16. The method according to claim 1, wherein separately folding the strip further comprises steps, after steps (a) and (b), of:

(c) re-extending the at least one of the leaves, clamped between the plurality of plates, and the plates from the second plurality of plates and into the funnel such that the one of the leaves folds, in a direction opposite to folding in step (a), along the fold line by contacting at least second first wall of the funnel, the second wall being opposite to the first wall of the funnel; and (d) retracting the one of the leaves and the plates from the second wall and into the second plurality of plates such that the one of the leaves, folded against the second wall, is unfolded along the fold line, in a direction opposite to the folding in step (b), by contacting a second tip of the second plurality of plates, the second tip being a tip of the plurality of plates opposite the first tip.

* * * * *